US011952645B2

(12) United States Patent
Liu et al.

(10) Patent No.: US 11,952,645 B2
(45) Date of Patent: Apr. 9, 2024

(54) REFINED GOSS-GRAIN ALUMINUM ALLOY PLATE AND PREPARATION METHOD THEREOF

(71) Applicants: Central South University, Changsha (CN); Changsha Xingxiao Material Technology Co., Ltd., Changsha (CN)

(72) Inventors: Zhiyi Liu, Changsha (CN); Fei Liu, Changsha (CN); Guangyu He, Changsha (CN)

(73) Assignees: Central South University, Changsha (CN); Changsha Xingxiao Material Technology Co., Ltd., Changsha (CN)

( * ) Notice: Subject to any disclaimer, the term of this patent is extended or adjusted under 35 U.S.C. 154(b) by 12 days.

(21) Appl. No.: 17/865,542

(22) Filed: Jul. 15, 2022

(65) Prior Publication Data

US 2024/0018634 A1 Jan. 18, 2024

(51) Int. Cl.

| | |
|---|---|
| ***C22C 21/16*** | (2006.01) |
| ***C21D 8/02*** | (2006.01) |
| ***C22C 14/00*** | (2006.01) |
| ***C22C 22/00*** | (2006.01) |

(52) U.S. Cl.

CPC ..... *C22C 21/16* (2013.01); *C21D 8/0226* (2013.01); *C21D 8/0236* (2013.01); *C22C 14/00* (2013.01); *C22C 22/00* (2013.01)

(58) Field of Classification Search

None

See application file for complete search history.

(56) References Cited

FOREIGN PATENT DOCUMENTS

| | | | | | |
|---|---|---|---|---|---|
| CN | 108504915 A | * | 9/2018 | ..... | C22C 21/14 |
| CN | 110093543 A | * | 8/2019 | ..... | C22C 21/14 |
| CN | 111254329 A | * | 6/2020 | | |

OTHER PUBLICATIONS

English language machine translation of CN-111254329-A. Generated Sep. 21, 2023. (Year: 2023).*

English language machine translation of CN-110093543-A. Generated Sep. 21, 2023. (Year: 2023).*

English language machine translation of CN-108504915-A. Generated Sep. 21, 2023. (Year: 2023).*

(Continued)

*Primary Examiner* — Brian D Walck

(74) *Attorney, Agent, or Firm* — Sage Patent Group

(57) ABSTRACT

Provided is a refined Goss-grain aluminum alloy plate and a preparation method thereof. The refined Goss-grain aluminum alloy plate includes the following compositions: 3.7-4.8 wt % of Cu, 1.2-1.7 wt % of Mg, 0.3-0.8 wt % of Mn, 0.03-0.10 wt % of Ti, and the balance of Al. The refined Goss-grain aluminum alloy plate is prepared by a method including subjecting an Al—Cu—Mg alloy ingot with a certain composition to a homogenizing at a temperature of 470-505° C., a hot rolling at high temperature of 465-495° C. with a large deformation of 80%-98% and a high final temperature, then directly to a cold rolling with a small or medium deformation of 5% to 50%, and then to a recrystallization and annealing treatment at a temperature of 300-450° C., a solid solution treatment at a temperature of 460-505° C., and a natural aging treatment for at least 96 hours.

2 Claims, 17 Drawing Sheets

(56) References Cited

OTHER PUBLICATIONS

Shen et al. "Effects of heating rate during solid-solution treatment on microstructure and fatigue properties of AA2524 T3 Al—Cu—Mg sheet." Materials and Design 104 (2016). pp. 116-125. (Year: 2016).*

Shen et al. "Semi-quantitative evaluation of texture components and anisotropy of the yield strength in 2524T3 alloy sheets." Materials Science & Engineering A 675 (2016) 386-395. (Year: 2016).*

* cited by examiner

REFINED GOSS-GRAIN ALUMINUM ALLOY PLATE AND PREPARATION METHOD THEREOF

TECHNICAL FIELD

The present disclosure relates to a method for preparing a refined Goss-grain aluminum alloy plate, which belongs to the technical field of preparation of non-ferrous metal materials.

BACKGROUND

Al—Cu—Mg alloys, such as 2024 and 2524 alloys, have higher damage tolerance and better fatigue crack propagation resistance compared with other aluminum alloys. Components at different positions of an aircraft fuselage bear different loading conditions, and the Al—Cu—Mg alloy is mainly used for aircraft skin materials. Thus, in order to meet the requirements of material optimization and reliability design, it is of great significance in practice to improve the fatigue damage resistance of the Al—Cu—Mg alloy by traditional processing and heat treatment on the premise of comprehensively considering the cost, preparation, processing and production processes.

At present, the research on improving the fatigue resistance of the Al—Cu—Mg alloys mainly includes the following aspects. (1) The fatigue resistance of the Al—Cu—Mg alloys could be improved through designing alloy composition. (2) The fatigue resistance of the alloys could be improved by controlling the Cu/Mg ratio of the Al—Cu—Mg alloys, which could adjust the microstructure characteristics of the alloy matrix, such as the type, morphology and precipitation quantity of a second phase particle. (3) The fatigue resistance of the alloys could be improved by deformation and heat treatment. CN10349811A describes that an aging process of the Al—Cu—Mg alloys in solid solution state could be controlled by introducing a pre-stretching, forming a large number of atomic clusters that could be repeatedly cut by dislocations, which could not only promote the reversible slip of dislocations, but also release the strain energy accumulated by crystal defects such as dislocations et al., reduce the tendency of fatigue crack propagation, and improve the fatigue resistance of the Al—Cu—Mg alloys. (4) The fatigue resistance of the Al—Cu—Mg alloys could be improved by controlling the environmental conditions of preparation and processing of the Al—Cu—Mg alloys. CN101921977A and CN101570839 disclose that the morphology and distribution of the second phase particles in the alloy matrix within the grain and on the grain boundary could be regulated by applying an external field (an electric field, a stress field and a temperature field) to the alloy.

In addition to the above-mentioned common ways to improve the fatigue resistance of the Al—Cu—Mg alloys, it has also been discovered for the first time that Goss-oriented grain and P-oriented grain could effectively hinder the fatigue crack propagation. CN108103373B and CN108504915B disclose that an Al—Cu—Mg alloy plate containing P texture and Goss+P composite texture with high intensity could be prepared by appropriately adjusting the heat treatment process for the alloy. Due to the existence of grain boundary components with large twist angles between neighboring grains and the Goss-oriented grains and P-oriented grains, a large deflection occurs when the fatigue crack propagation reaches to the Goss-oriented grains and P-oriented grains, delaying the fatigue crack propagation and releasing the thermodynamic energy of the fatigue crack, which could effectively inhibit the fatigue crack propagation.

In the prior art for preparing a fatigue-resistant aluminum alloy, the fatigue-resistant aluminum alloy containing Goss texture or P texture or Goss+P texture with high intensity could be obtained by adjusting the grain orientation of the alloy, and the preparation, processing and production technologies thereof are mainly disclosed in the following patents applied by the present inventor: 1. CN103045976A, which discloses a heat treatment process of a cold rolled Goss plate and an obtained fatigue-resistant aging plate with a Goss texture intensity of 6.52; 2. CN103526140A, which discloses that the fatigue resistance of an cold rolled alloy plate could be optimized after the cold rolled alloy plate is subjected to a solid solution treatment under high temperature for a short time; 3. CN10358997A, which discloses a method for preparing a Goss textured plate by using a hot rolling with a small deformation, a first solid solution treatment, a cold rolling with a large deformation, a second solid solution treatment, and a natural aging treatment, and that the Goss textured plate has a Goss texture intensity of 3.72; 4. CN108103373B, which discloses a silver-containing Al—Cu—Mg alloy and a heat treatment method for obtaining a P texture with high intensity, and that the method could result in an aluminum alloy plate with a P texture intensity of not less than 3.5; and 5. CN108504915B, which discloses an Al—Cu—Mg alloy with a high Goss+P texture intensity and an excellent fatigue resistance and a preparation method thereof, and that the method could result in an aluminum alloy plate with a Goss+P texture intensity of not less than 19.

At present, an aluminum alloy plate with a high Goss texture intensity could be prepared in the prior art, but the plate has a coarse Goss grain size, generally several hundreds of microns. Studies have shown that, under the condition that the grain size of the aluminum alloy is reduced to a micron level, the fatigue crack propagation resistance of the aluminum alloy could be effectively improved; under the condition that the grain size of the alloy reaches a submicron scale, the fatigue resistance of the aluminum alloy would be deteriorated due to the instability of the microstructure of the alloy. For the Goss aluminum alloy plate with fatigue resistance prepared in the prior art, since the influence of the Goss grain size on the fatigue resistance has been ignored during the preparation of the plate, there is still considerable room for improvement in the fatigue resistance of the plate. Generally, the methods for refining aluminum alloy grains mainly include: high pressure and torsion (HPT), equal channel angular pressing (ECAP) and accumulative roll bonding (ARB). However, the alloy materials prepared by these methods are small in size, only suitable for laboratory theoretical research, but not suitable for large-scale industrial production applications, and also high in cost. Besides, the texture types of the plates prepared by these methods are largely different from those prepared by traditional rolling, and thus it is not conducive to obtaining a recrystallized Goss texture with high intensity. In addition, the grain size of the aluminum alloy could also be reduced by adding a grain refiner to the alloy melt or adjusting the solidification parameters. For example, in patents CN111893352A and CN111424195A, the as-cast microstructure of the aluminum alloy has been refined by adding a grain refiner or other alloy chips with the same effect as the refiner, thereby improving the mechanical properties of the aluminum alloy. In patent CN111004938A, the as-cast microstructure of the aluminum alloy has been refined by adjusting the parameters of the solidification process. In patent CN109722555A, the as-cast grains of the aluminum alloy have been refined by optimizing the alloy smelting parameters. Nevertheless, the main defects in the above patents lie in that although the grain size of the aluminum alloy could be reduced to a certain extent, it is impossible to refine the specifically oriented grains (such as Goss-oriented grains); this is because in order to obtain excellent fatigue damage resistance, it is necessary to not only refine the Goss grains but also ensure a high Goss texture intensity. In addition, the use of grain refiner to refine the grains of the aluminum alloy would not only increase the cost, but also complicate the process for preparing alloys. Therefore, it is necessary to reconsider and design an addition scheme of grain refiners in the process of alloy melting and solidification. However, whether by adjusting the parameters of the alloy solidification process or optimizing the parameters of the alloy smelting process, these methods may increase the workload in the alloy preparation process, indirectly increase the cost of the alloy preparation process, and generate a large amount of industrial wastes, which is not in line with the current concept of green and sustainable development. Therefore, the existing published methods for refining the grain size of the aluminum alloy could not solve the problem of greatly refining Goss grains on the premise of ensuring high Goss texture intensity.

SUMMARY

To overcome the defects of the coarse Goss grain size of the aluminum alloy plate with high Goss texture intensity prepared in the prior art, in the present disclosure recrystallized Goss grains with small size and stable structure are obtained by changing the deformation of the cold rolling to control the deformation stored energy of the alloy to regulate the recrystallization degree of the alloy, thereby solving the problem of difficulty to greatly refine Goss grains on the premise of ensuring high Goss texture intensity. The present disclosure provides a simple process, which makes it possible to prepare a cold-rolled aluminum alloy plate with a Goss grain size of less than 20 μm, and is suitable for large-scale industrial production and application.

The present disclosure provides the following technical solutions:

Provided is a refined Goss-grain aluminum alloy plate, comprising the following compositions: 3.7-4.8 wt % of Cu, 1.2-1.7 wt % of Mg, 0.3-0.8 wt % of Mn, 0.03-0.10 wt % of Ti, and the balance of Al, wherein the refined Goss-grain aluminum alloy plate has a Goss texture intensity of not less than 3.9.

In some embodiments, the refined Goss-grain aluminum alloy plate is prepared by a method comprising subjecting an Al—Cu—Mg alloy ingot to a homogenizing, a hot rolling at high temperature with a large deformation and a high final temperature, then directly to a cold rolling with a small or medium deformation, and then to a recrystallization and annealing treatment, a solid solution treatment, a water quenching, and a natural aging treatment.

In some embodiments, the homogenizing is performed at a temperature of 470-505° C. for 24-96 hours.

In some embodiments, the hot rolling at high temperature with a large deformation and a high final temperature is performed at a temperature of 465-495° C., with a rolling deformation of 80%-98% and a final temperature of not less than 380° C.

In some embodiments, the cold rolling with a small or medium deformation is performed directly after the hot rolling under a rolling deformation of a single-pass and a multi-pass cold rolling of 5%-50%; preferably, the cold rolling with a small or medium deformation is performed at ambient temperature under a rolling deformation of a single-pass and a multi-pass cold rolling of 12%-50%; more preferably, the cold rolling with a small or medium deformation is performed at ambient temperature under a rolling deformation of a single-pass and a multi-pass cold rolling of 20%-40%.

In some embodiments, the recrystallization and annealing treatment is performed at a temperature of 300-450° C. for 60-300 minutes.

In some embodiments, the solid solution treatment is performed at a temperature of 460-505° C. for 5-90 minutes, and quenched with water.

In some embodiments, the natural aging treatment is performed at ambient temperature for at least 96 hours.

In some embodiments, the refined Goss-grain aluminum alloy plate has a Goss grain size of less than 100 μm.

In some embodiments, the refined Goss-grain aluminum alloy plate has a Goss grain size of not more than 20 μm.

It has been found that the hot rolling at high temperature with a large deformation makes it possible to promote the activation of the non-octahedral slip system in the aluminum alloy and obtain a strong Brass texture. In this way, the strong Brass texture could be transformed into a strong Goss texture after the subsequent recrystallization and annealing treatment and solid solution treatment, and thereby the fatigue crack propagation resistance of the aluminum alloy could be greatly improved. However, the Goss grains obtained in the previously authorized patents (CN103045976A, CN103526140A, CN10358997A, CN108103373B, CN103526140B and CN108504915B) have a relatively larger size, reaching several hundreds of microns. Refining Goss grains could undoubtedly further improve the fatigue crack propagation resistance of the alloy. How to refine Goss grains on the premise of ensuring high Goss texture intensity? It has been found that under the condition that the plate that has undergone the hot rolling at high temperature with a large deformation and a high final temperature is directly cold-rolled with a controlled deformation (5-50%) such that the Brass texture intensity of the plate is not significantly reduced. In this way, the increased deformation stored energy in the plate makes it possible to not only obtain a high Goss texture intensity, but also significantly refine the grains in the subsequent processes of recrystallization and annealing treatment and solid solution treatment. Thus, a refined Goss-grain aluminum alloy plate with high intensity could be finally obtained.

The technologies previously disclosed by the present inventors in patents CN103045976A, CN103526140A, CN10358997A, CN108103373B, CN103526140B and CN108504915B make it possible to obtain aluminum alloy plates with high Goss texture or P texture or Goss+P texture intensity, but the above plates fail to achieve significant refinement of Goss grains or P grains or Goss+P grains, which leave room for further improvement in the fatigue resistance brought by Goss texture, P texture and Goss+P texture. The present disclosure makes it possible to remarkably refine Goss grains on the premise of obtaining a high Goss texture intensity, which could further improve the fatigue resistance of the Goss textured aluminum alloy plate.

Potential Beneficial Effects

Compared with the prior art, the present disclosure may have one or more of the following beneficial effects:

The method of the present disclosure is simple and reasonable. The present disclosure makes it possible to increase the recrystallization driving force and recrystallization nucleation rate of the aluminum alloy plates during the annealing and solid solution treatments on the premise of not significantly affecting the Brass texture by the hot rolling at high temperature with a large deformation and a high final temperature, as well as the cold rolling with a small or medium deformation. Therefore, the grains are refined on the premise of obtaining a Goss texture with high intensity, and a refined Goss-grain aluminum alloy plate suitable for industrial production and application could be successfully prepared.

The present disclosure makes it possible to solve the problem that the Goss grains have a size of several hundreds of microns in the aluminum alloy plate with high Goss texture intensity obtained in the prior art. In the present disclosure, recrystallized Goss grains with small size and stable structure could be obtained by changing the deformation of the cold rolling to control the deformation stored energy of the alloy so as to regulate the recrystallization degree of the alloy. The method of present disclosure has a simple process, makes it possible to prepare a cold-rolled aluminum alloy plate with a Goss grain size of less than 20 μm, and is suitable for large-scale industrial production and application.

DETAILED DESCRIPTION OF THE EMBODIMENTS

Figure 1:
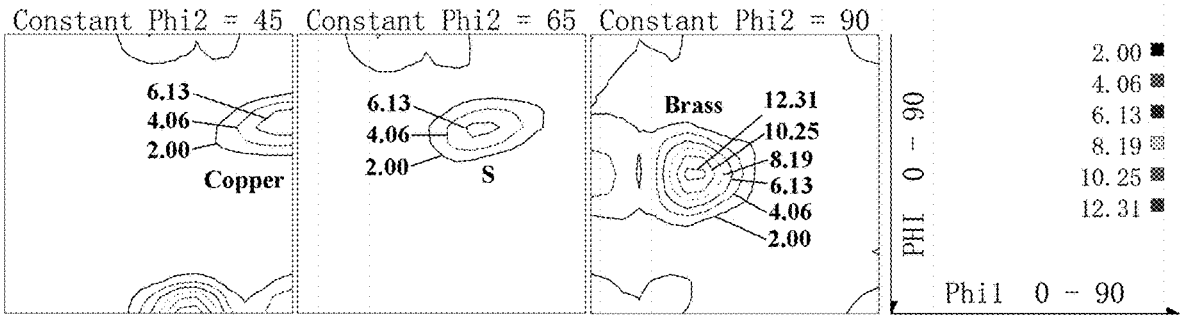
FIG. 1 shows the orientation distribution function (ODF) sections of the hot-rolled alloy plate as prepared in example 4.

In order to make the objects, technical solutions and advantages of the present disclosure clearer, the present disclosure will be further described in detail below with reference to the examples. It should be understood that the specific examples described herein are only used to explain the present disclosure, but not to limit the present disclosure.

Example 1

An alloy in this example was provided with the following compositions: 4.3% of Cu, 1.3% of Mg, 0.6% of Mn, 0.09% of Ti, and the balance of Al.

The alloy was subjected to a homogenizing at 480° C. for 48 hours, and then to a hot rolling at 470° C. with a deformation of 83% and a final rolling temperature of not less than 380° C. to obtain a hot-rolled alloy plate. The hot-rolled alloy plate was then subjected to a cold rolling with a deformation of 5% to obtain a cold-rolled alloy plate. The cold-rolled alloy plate was subjected to a recrystallization and annealing treatment at 360° C. for 240 minutes, a solid solution treatment at 460° C. for 90 minutes, a water quenching, and a natural aging treatment for at least 96 hours to obtain an aged alloy plate with a Goss texture intensity of 7.03 and a Goss grain size of 45.14 μm.

Example 2

An alloy in this example was provided with the following compositions: 3.7% of Cu, 1.2% of Mg, 0.7% of Mn, 0.06% of Ti, and the balance of Al.

The alloy was subjected to a homogenizing at 485° C. for 24 hours, and then to a hot rolling at 480° C. with a deformation of 88% and a final rolling temperature of not less than 380° C. to obtain a hot-rolled alloy plate. The hot-rolled alloy plate was then subjected to a cold rolling with a deformation of 13% to obtain a cold-rolled alloy plate. The cold-rolled alloy plate was subjected to a recrystallization and annealing treatment at 390° C. for 120 minutes, a solid solution treatment at 465° C. for 30 minutes, a water quenching, and a natural aging treatment for at least 96 hours to obtain an aged alloy plate with a Goss texture intensity of 8.35 and a Goss grain size of 39.81 μm.

Example 3

An alloy in this example was provided with the following compositions: 3.8% of Cu, 1.6% of Mg, 0.4% of Mn, 0.06% of Ti, and the balance of Al.

The alloy was subjected to a homogenizing at 495° C. for 72 hours, and then to a hot rolling at 485° C. with a deformation of 90% and a final rolling temperature of not less than 380° C. to obtain a hot-rolled alloy plate. The hot-rolled alloy plate was then subjected to a cold rolling with a deformation of 20% to obtain a cold-rolled alloy plate. The cold-rolled alloy plate was subjected to a recrystallization and annealing treatment at 450° C. for 60 minutes, a solid solution treatment at 480° C. for 90 minutes, a water quenching, and a natural aging treatment for at least 96 hours to obtain an aged alloy plate with a Goss texture intensity of 10.17 and a Goss grain size of 35.16 μm.

Example 4

An alloy in this example was provided with the following compositions: 4.1% of Cu, 1.3% of Mg, 0.6% of Mn, 0.03% of Ti, and the balance of Al.

The alloy was subjected to a homogenizing at 500° C. for 96 hours, and then to a hot rolling at 490° C. with a deformation of 95% and a final rolling temperature of not less than 380° C. to obtain a hot-rolled alloy plate. The hot-rolled alloy plate was then subjected to a cold rolling with a deformation of 26% to obtain a cold-rolled alloy plate. The cold-rolled alloy plate was subjected to a recrystallization and annealing treatment at 360° C. for 60 minutes, a solid solution treatment at 490° C. for 20 minutes, a water quenching, and a natural aging treatment for at least 96 hours to obtain an aged alloy plate with a Goss texture intensity of 10.20 and a Goss grain size of 23.44 μm.

Example 5

An alloy in this example was provided with the following compositions: 4.7% of Cu, 1.3% of Mg, 0.4% of Mn, 0.09% of Ti, and the balance of Al.

The alloy was subjected to a homogenizing at 505° C. for 72 hours, and then to a hot rolling at 495° C. with a deformation of 98% and a final rolling temperature of not less than 380° C. to obtain a hot-rolled alloy plate. The hot-rolled alloy plate was then subjected to a cold rolling with a deformation of 32% to obtain an cold-rolled alloy plate. The cold-rolled alloy plate was subjected to a recrystallization and annealing treatment at 300° C. for 300 minutes, a solid solution treatment at 505° C. for 30 minutes, a water quenching, and a natural aging treatment for at least 96 hours to obtain an aged alloy plate with a Goss texture intensity of 11.10 and a Goss grain size of 62.42 μm.

Example 6

An alloy in this example was provided with the following compositions: 4.1% of Cu, 1.6% of Mg, 0.3% of Mn, 0.03% of Ti, and the balance of Al.

The alloy was subjected to a homogenizing at 475° C. for 24 hours, and then to a hot rolling at 470° C. with a deformation of 86% and a final rolling temperature of not less than 380° C. to obtain a hot-rolled alloy plate. The hot-rolled alloy plate was then subjected to a cold rolling with a deformation of 35% to obtain a cold-rolled alloy plate. The cold-rolled alloy plate was subjected to a recrystallization and annealing treatment at 340° C. for 240 minutes, a solid solution treatment at 465° C. for 5 minutes, a water quenching, and a natural aging treatment for at least 96 hours to obtain an aged alloy plate with a Goss texture intensity of 7.44 and a Goss grain size of 37.42 μm.

Example 7

An alloy in this example was provided with the following compositions: 4.7% of Cu, 1.3% of Mg, 0.6% of Mn, 0.06% of Ti, and the balance of Al.

The alloy was subjected to a homogenizing at 505° C. for 24 hours, and then to a hot rolling at 465° C. with a deformation of 83% and a final rolling temperature of not less than 380° C. to obtain a hot-rolled alloy plate. The hot-rolled alloy plate was then subjected to a cold rolling with a deformation of 39% to obtain a cold-rolled alloy plate. The cold-rolled alloy plate was subjected to a recrystallization and annealing treatment at 420° C. for 120 minutes, a solid solution treatment at 505° C. for 20 minutes, a water quenching, and a natural aging treatment for at least 96 hours to obtain an aged alloy plate with a Goss texture intensity of 4.95 and a Goss grain size of 19.04 μm.

Example 8

An alloy in this example was provided with the following compositions: 3.7% of Cu, 1.2% of Mg, 0.8% of Mn, 0.10% of Ti, and the balance of Al.

The alloy was subjected to a homogenizing at 470° C. for 96 hours, and then to a hot rolling at 465° C. with a deformation of 98% and a final rolling temperature of not less than 380° C. to obtain a hot-rolled alloy plate. The hot-rolled alloy plate was then subjected to a cold rolling with a deformation of 16% to obtain a cold-rolled alloy plate. The cold-rolled alloy plate was subjected to a recrystallization and annealing treatment at 450° C. for 180 minutes, and a natural aging treatment for at least 96 hours to obtain an annealed alloy plate with a Goss texture intensity of 8.73.

Comparative Example 1

An alloy in this comparative example was provided with the following compositions: 4.7% of Cu, 1.6% of Mg, 0.4% of Mn, 0.10% of Ti, and the balance of Al.

The alloy was subjected to a homogenizing at 480° C. for 36 hours, and then subjected to a hot rolling at 475° C. with a deformation of 80% and a final rolling temperature of not less than 380° C. to obtain a hot-rolled alloy plate. The hot-rolled alloy plate was then subjected to a cold rolling with a deformation of 50% to obtain a cold-rolled alloy plate. The cold-rolled alloy plate was subjected to a recrystallization and annealing treatment at 300° C. for 240 minutes, and a natural aging treatment for at least 96 hours to obtain an annealed alloy plate with a Goss texture intensity of 3.99.

Comparative Example 2

An alloy in this comparative example was provided with the following compositions: 3.7% of Cu, 1.4% of Mg, 0.3% of Mn, 0.04% of Ti, and the balance of Al.

The alloy was subjected to a homogenizing at 470° C. for 24 hours, and then to a hot rolling at 465° C. with a deformation of 78% to obtain a hot-rolled alloy plate. The hot-rolled alloy plate was then subjected to a cold rolling with a deformation of 55% to obtain a cold-rolled alloy plate. The cold-rolled alloy plate was subjected to a recrystallization and annealing treatment at 420° C. for 180 minutes, and a natural aging treatment for at least 96 hours to obtain an annealed alloy plate with a Goss texture intensity of 2.77.

Comparative Example 3

An alloy in this comparative example was provided with the following compositions: 4.5% of Cu, 1.2% of Mg, 0.5% of Mn, 0.05% of Ti, and the balance of Al.

The alloy was subjected to a homogenizing at 470° C. for 96 hours, and then to a hot rolling at 465° C. with a deformation of 80% to obtain a hot-rolled alloy plate. The hot-rolled alloy plate was then subjected to a cold rolling with a deformation of 52% to obtain a cold-rolled alloy plate. The cold-rolled alloy plate was subjected to a recrystallization and annealing treatment at 360° C. for 60 minutes, and a natural aging treatment for at least 96 hours to obtain an annealed alloy plate with a Goss texture intensity of 3.15.

Figure 2:
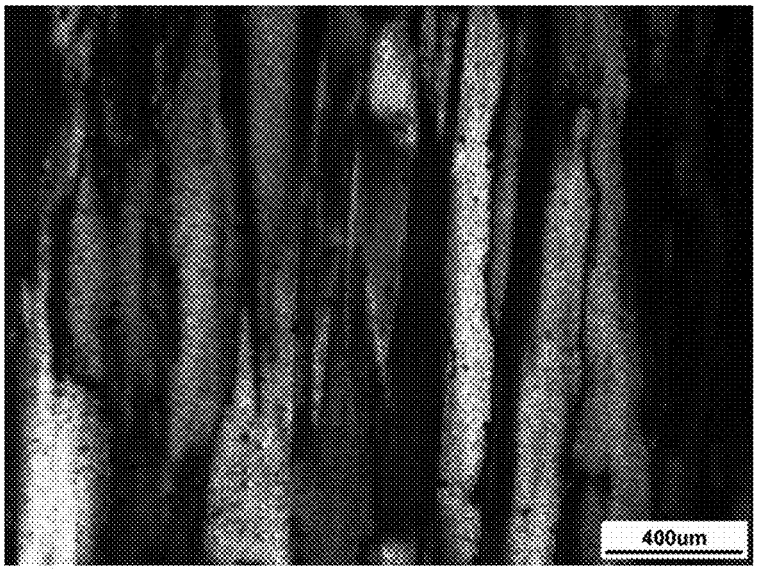
FIG. 2 shows the optical microstructure of the hot-rolled alloy plate as prepared in example 4.
Figure 3:
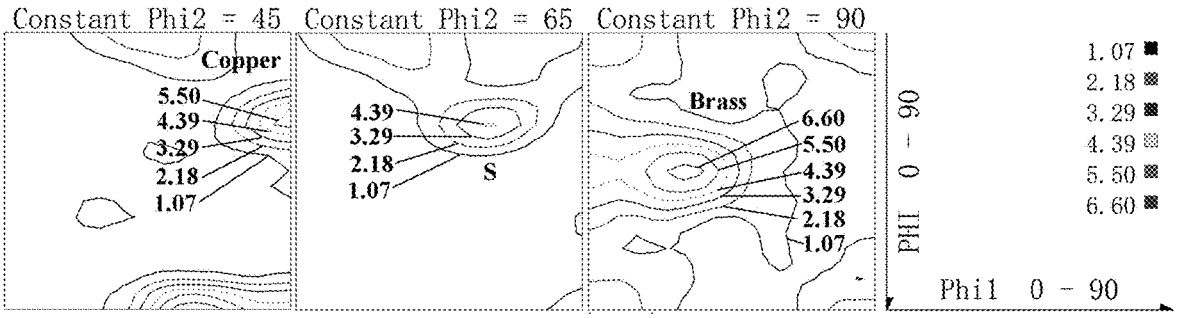
FIG. 3 shows the ODF sections of the hot-rolled alloy plate as prepared in comparative example 1.
Figure 4:
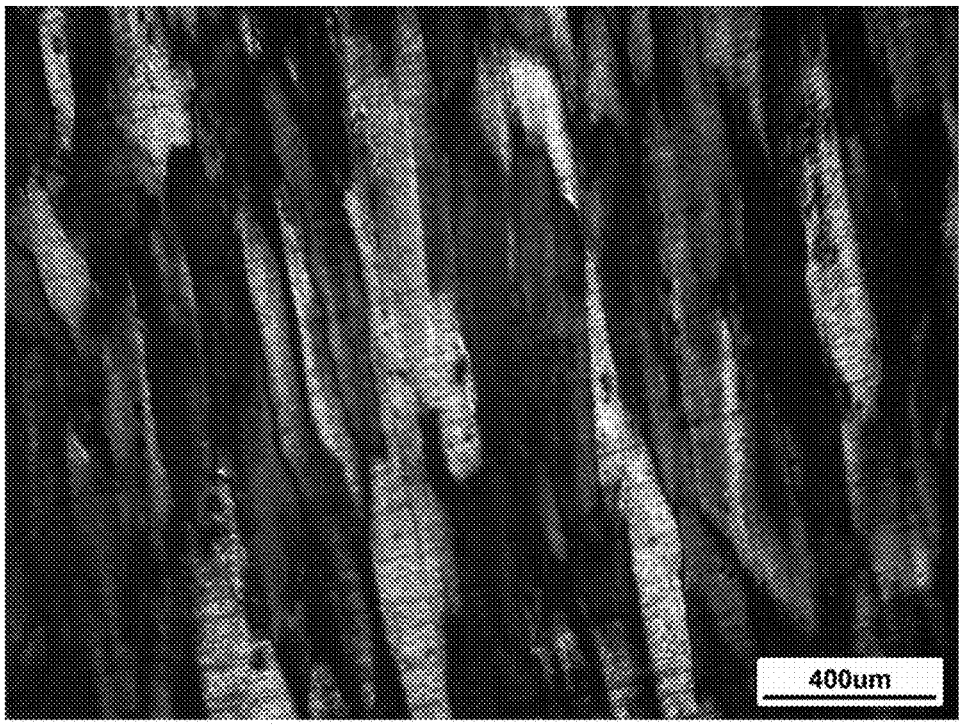
FIG. 4 shows the optical microstructure of the hot-rolled alloy plate as prepared in comparative example 1.
Figure 5:
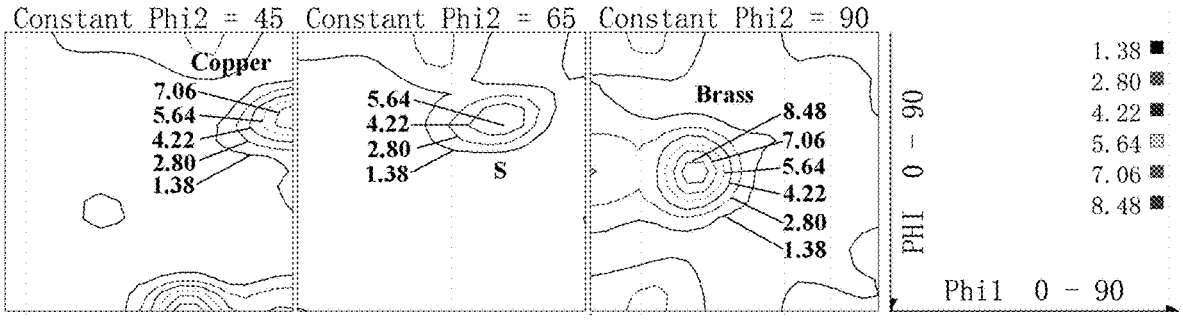
FIG. 5 shows the ODF sections of the cold-rolled alloy plate as prepared in example 2.
Figure 6:
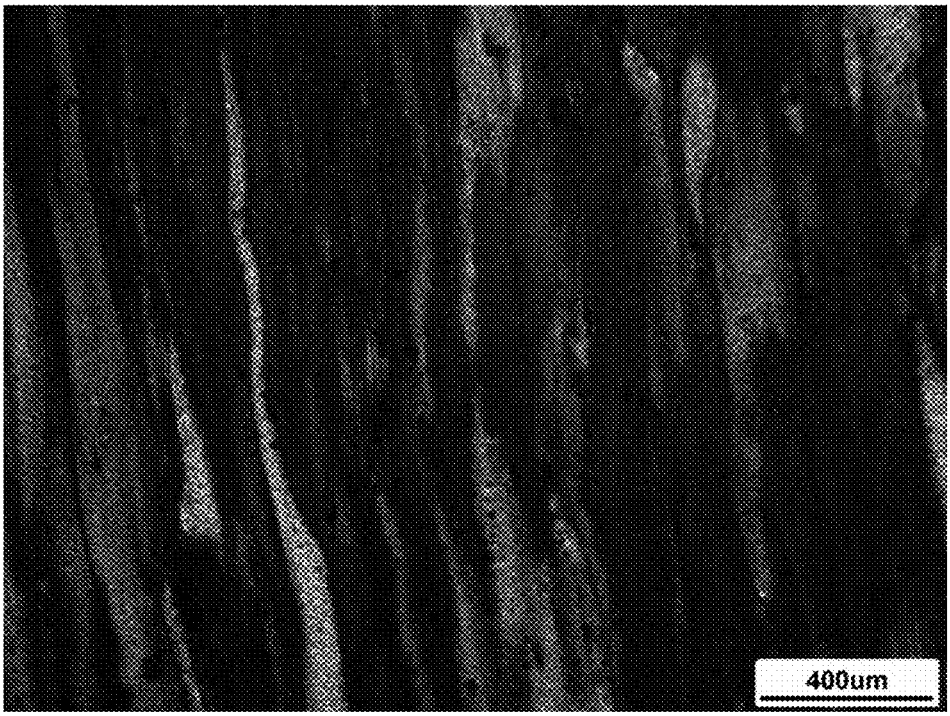
FIG. 6 shows the optical microstructure of the cold-rolled alloy plate as prepared in example 2.
Figure 7:
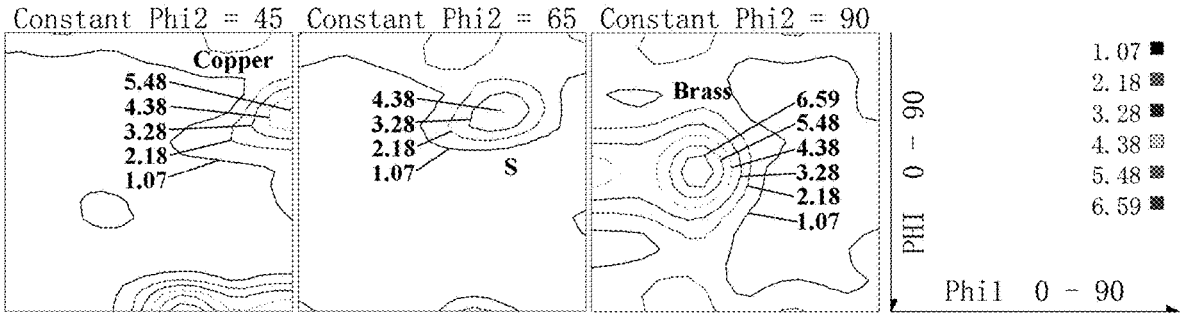
FIG. 7 shows the ODF sections of the cold-rolled alloy plate as prepared in example 5.
Figure 8:
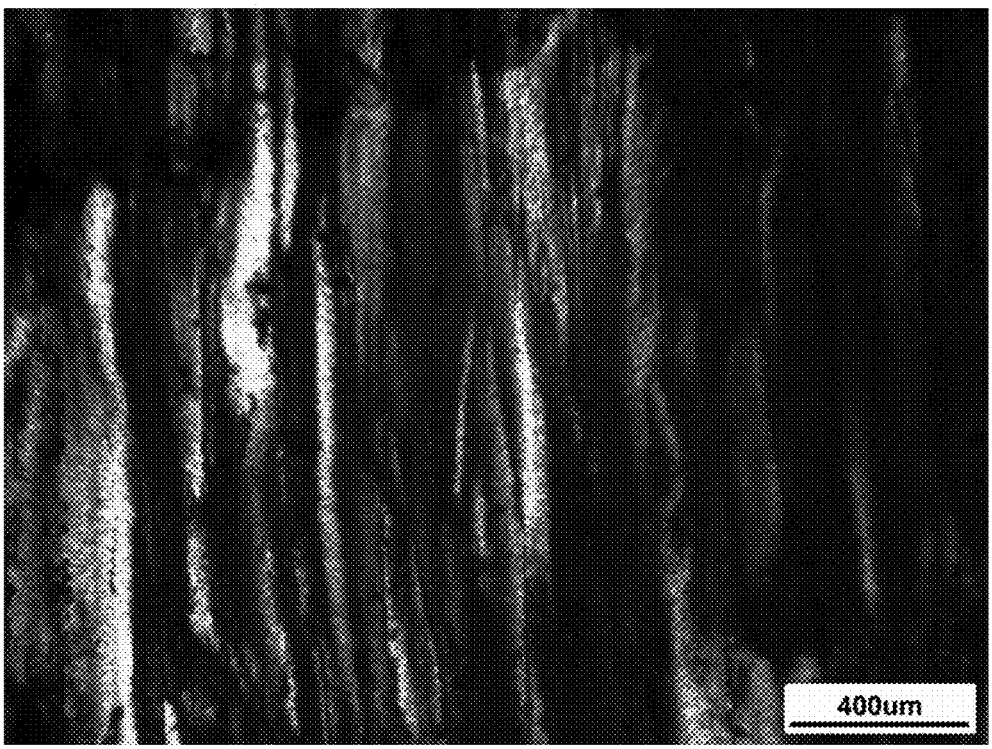
FIG. 8 shows the optical microstructure of the cold-rolled alloy plate as prepared in example 5.
Figure 9:
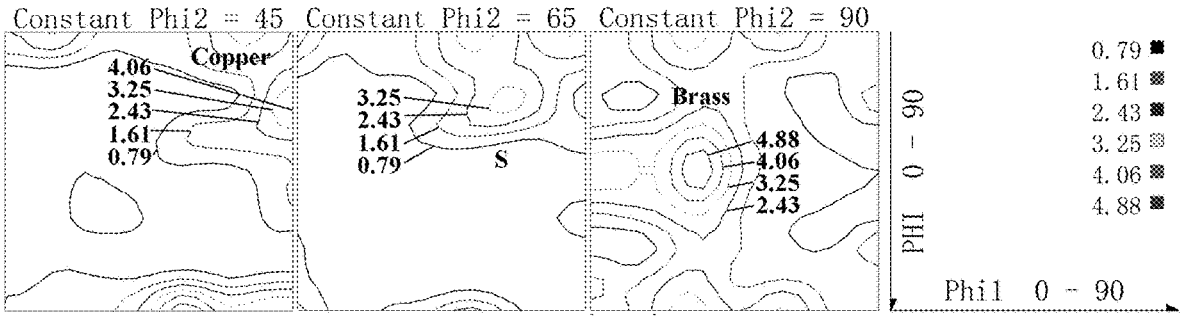
FIG. 9 shows the ODF sections of the cold-rolled alloy plate as prepared in comparative example 1.
Figure 10:
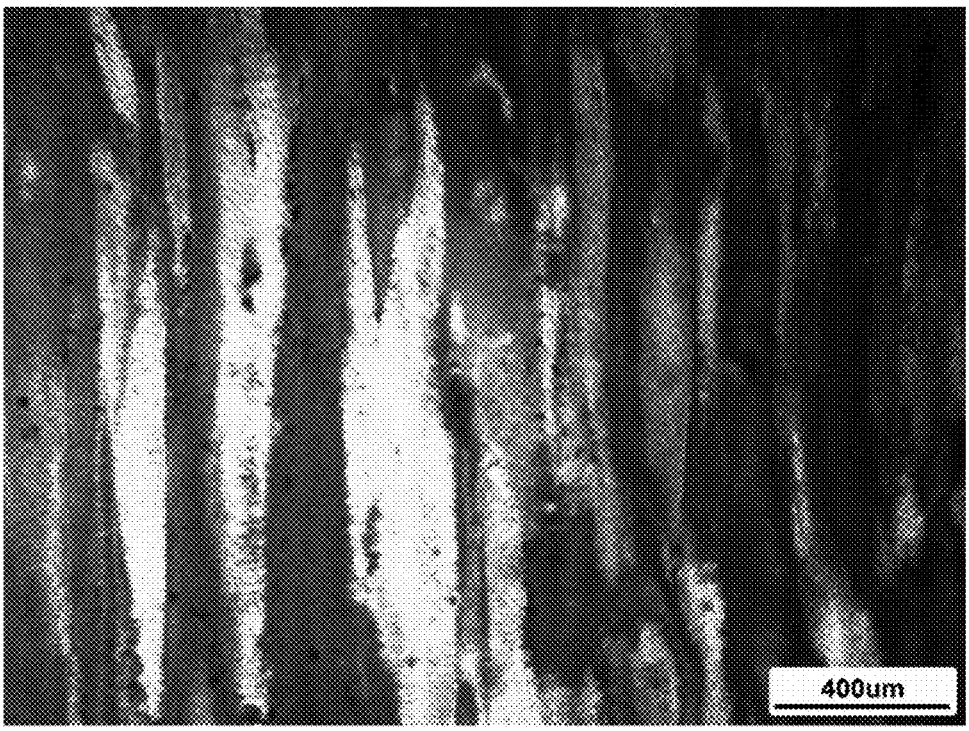
FIG. 10 shows the optical microstructure of the cold-rolled alloy plate as prepared in comparative example 1.
Figure 11:
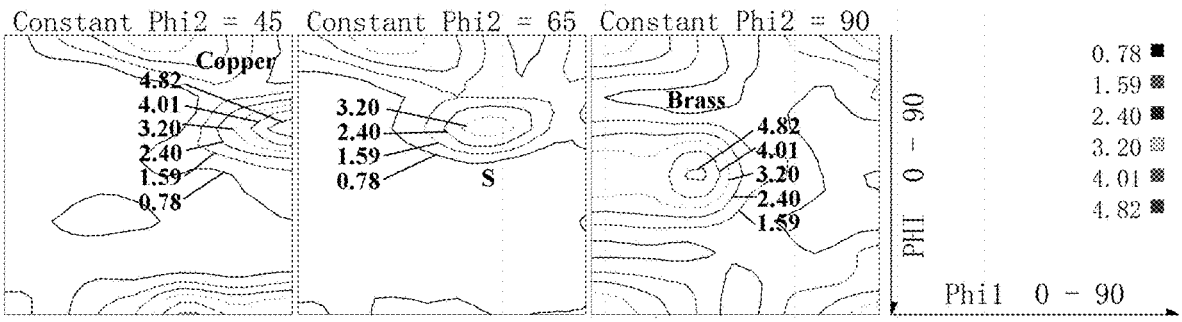
FIG. 11 shows the ODF sections of the cold-rolled alloy plate as prepared in comparative example 3.
Figure 12:
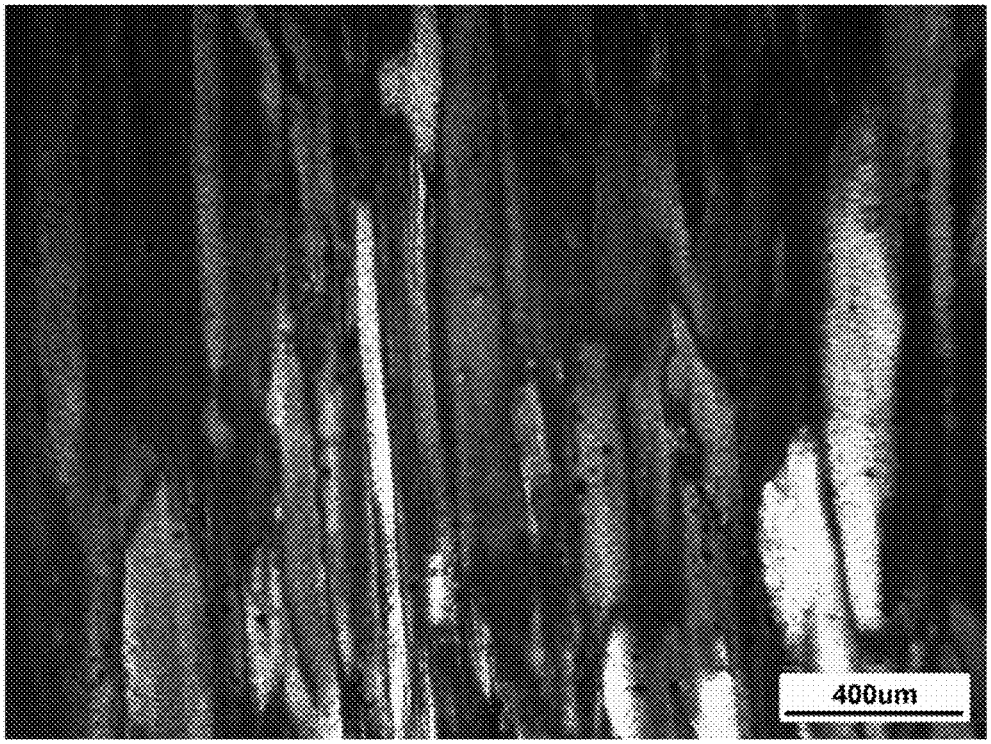
FIG. 12 shows the optical microstructure of the cold-rolled alloy plate as prepared in comparative example 3.
Figure 13:
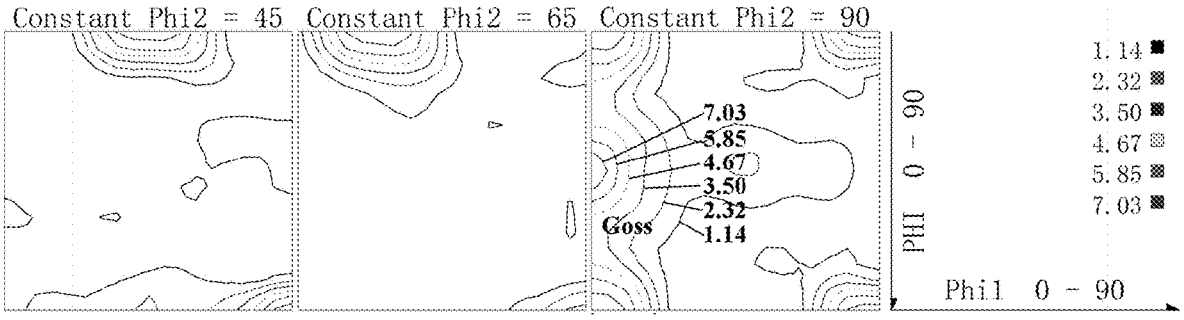
FIG. 13 shows the ODF sections of the aged alloy plate as prepared in example 1.
Figure 14A:
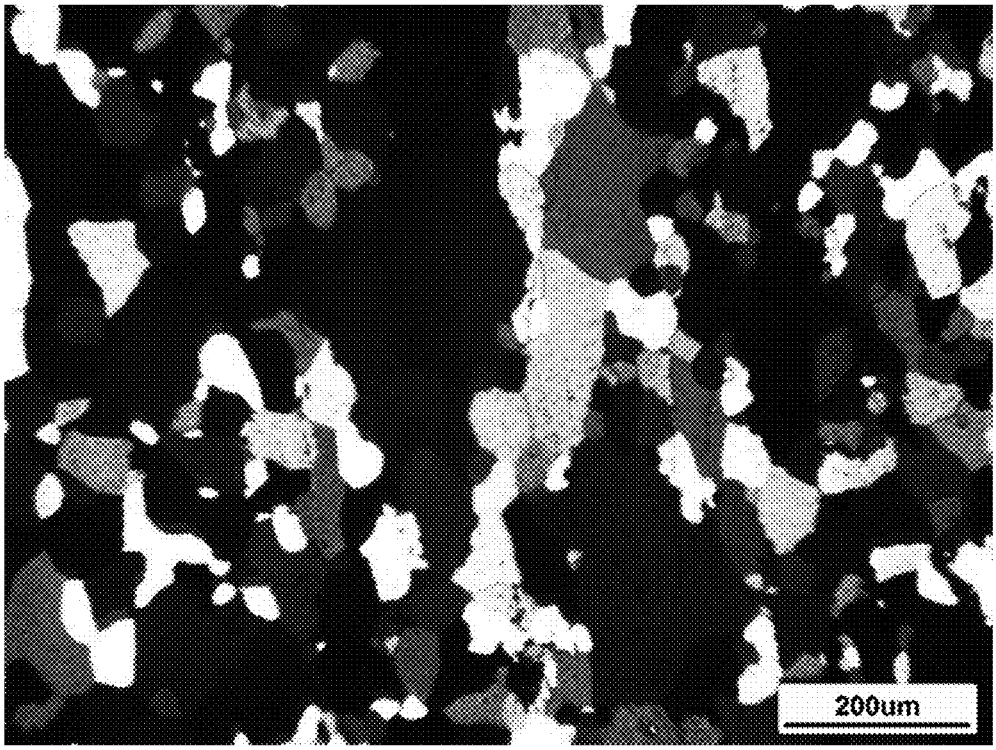
FIG. 14A shows the optical microstructure of the aged alloy plate as prepared in example 1.
Figure 14B:
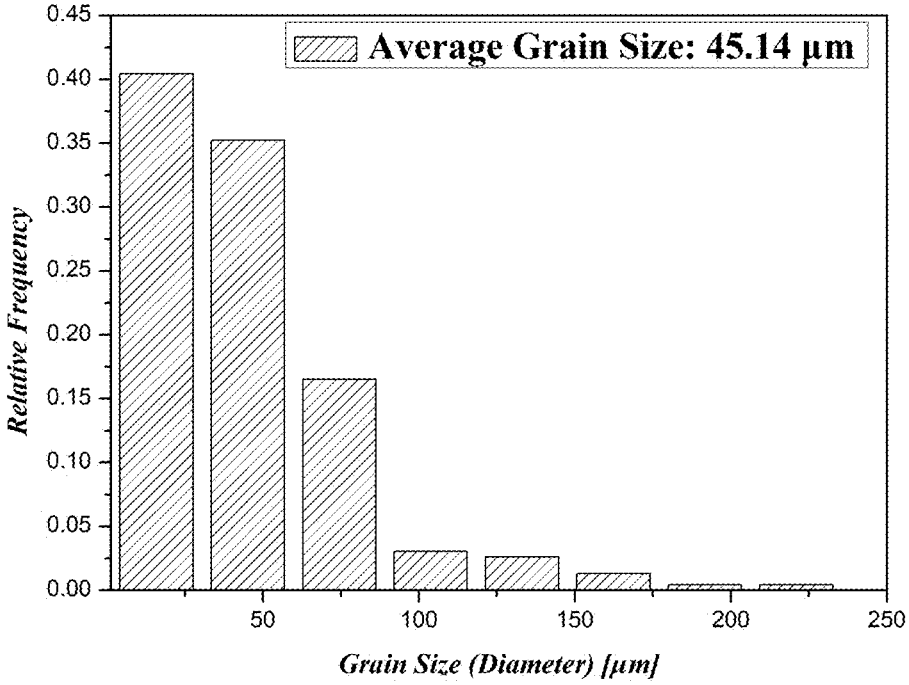
FIG. 14B shows the grain size distribution of the aged alloy plate as prepared in example 1.
Figure 15:
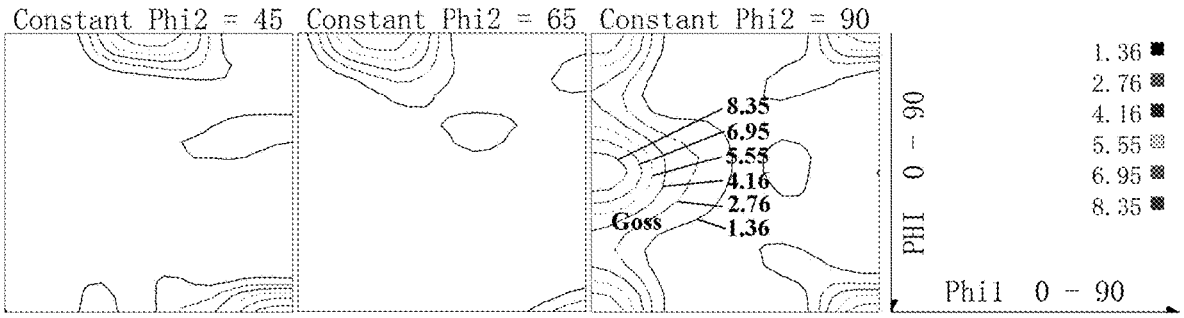
FIG. 15 shows the ODF sections of the aged alloy plate as prepared in example 2.
Figure 16A:
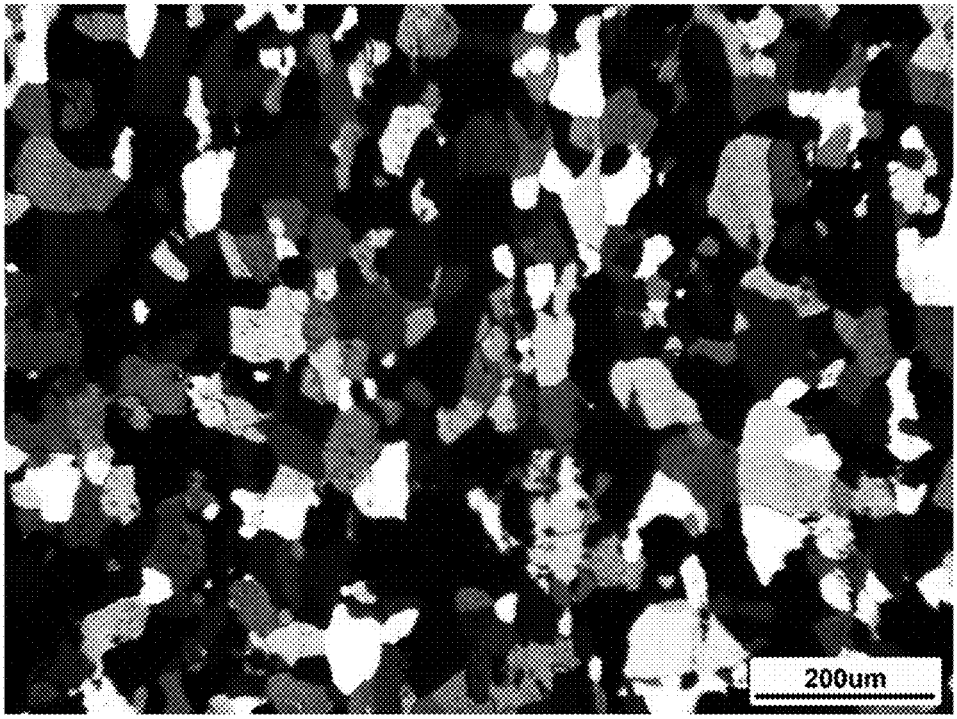
FIG. 16A shows the optical microstructure of the aged alloy plate as prepared in example 2.
Figure 16B:
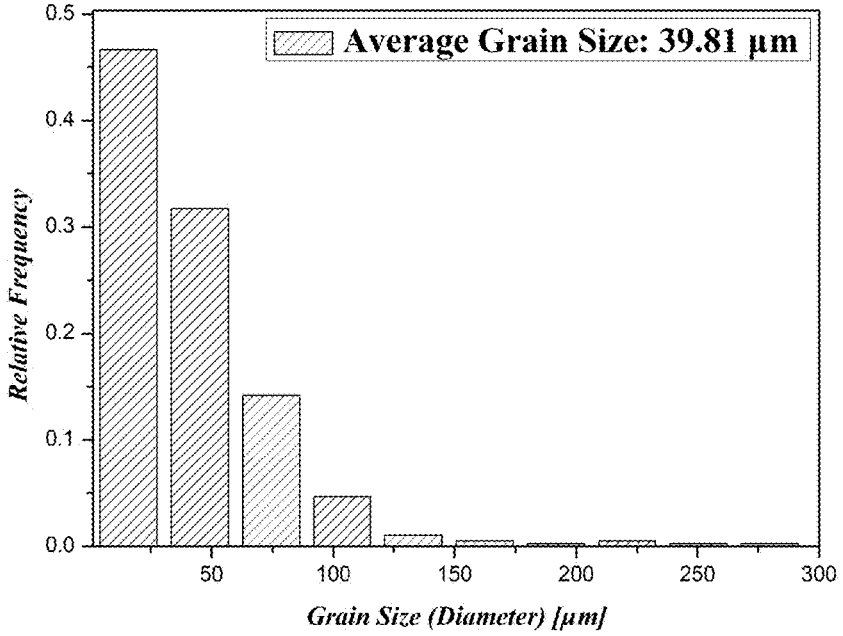
FIG. 16B shows the grain size distribution of the aged alloy plate as prepared in example 2.
Figure 17:
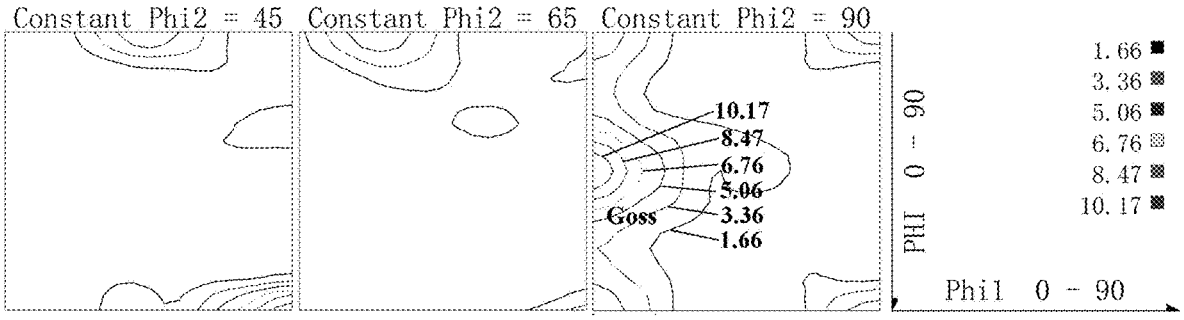
FIG. 17 shows the ODF sections of the aged alloy plate as prepared in example 3.
Figure 18A:
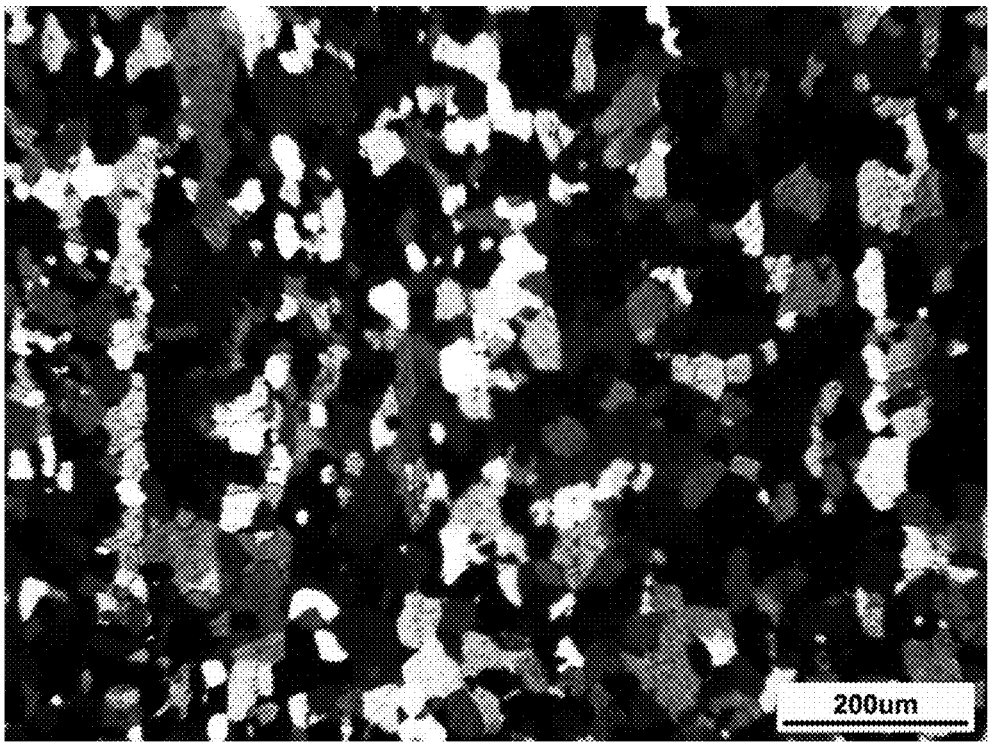
FIG. 18A shows the optical microstructure of the aged alloy plate as prepared in example 3.
Figure 18B:
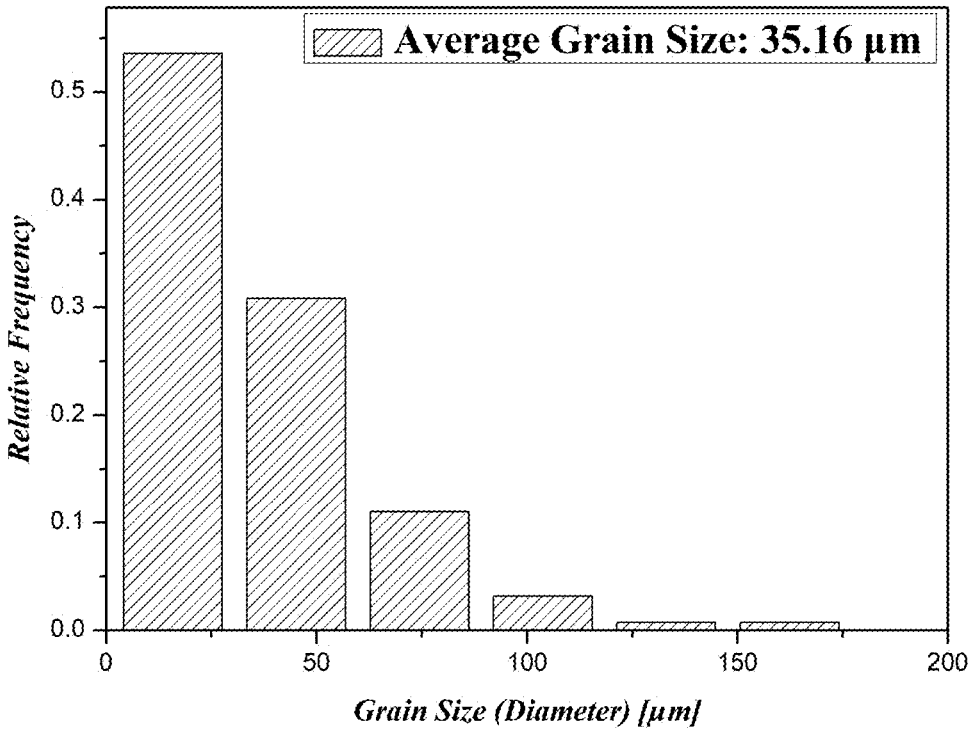
FIG. 18B shows the grain size distribution of the aged alloy plate as prepared in example 3.
Figure 19:
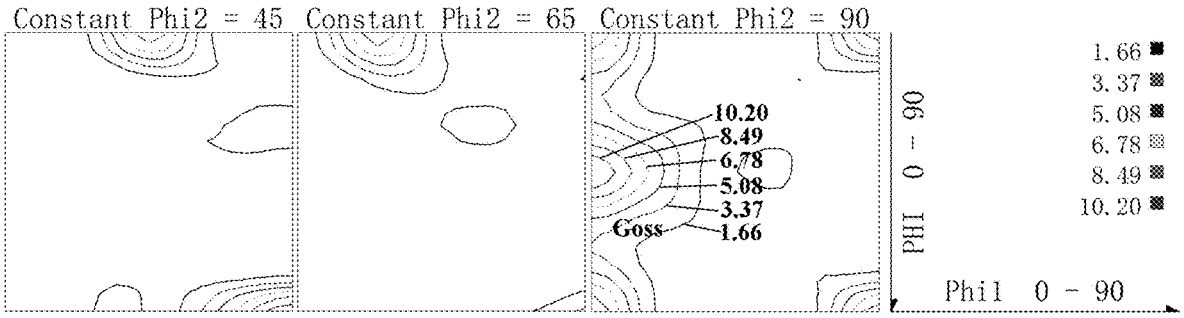
FIG. 19 shows the ODF sections of the aged alloy plate as prepared in example 4.
Figure 20A:
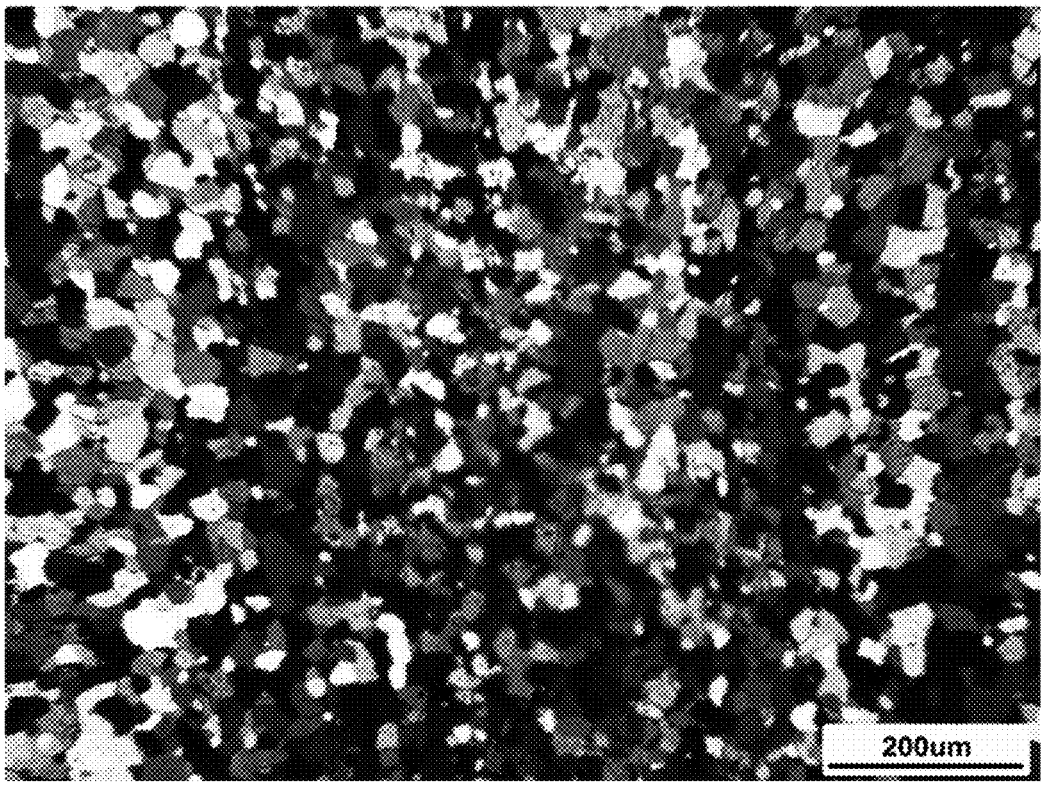
FIG. 20A shows the optical microstructure of the aged alloy plate as prepared in example 4.
Figure 20B:
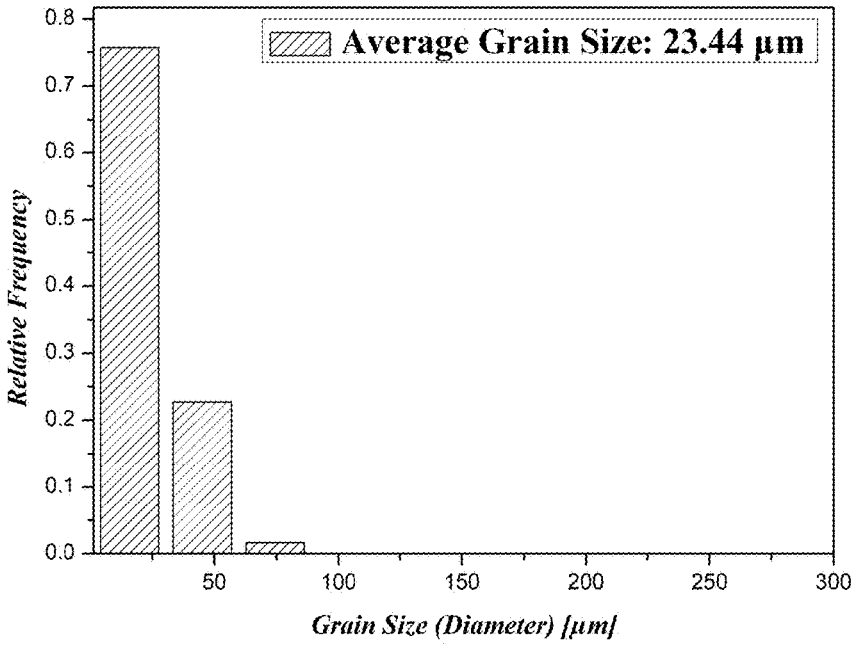
FIG. 20B shows the grain size distribution of the aged alloy plate as prepared in example 4.
Figure 21:
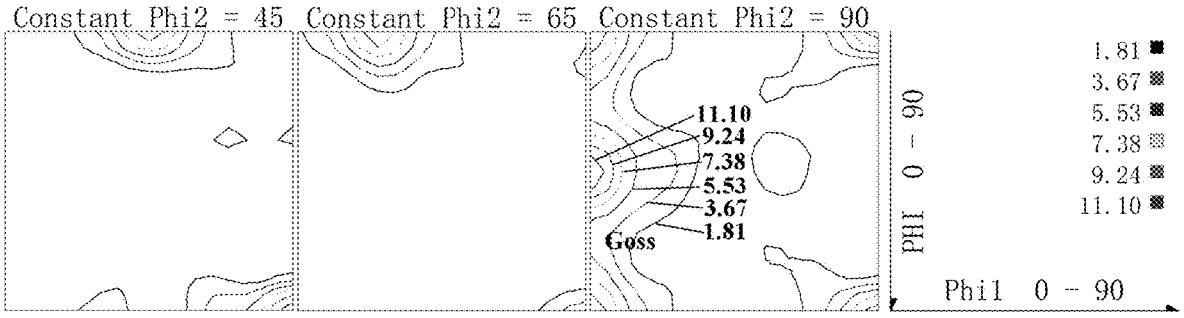
FIG. 21 shows the ODF sections of the aged alloy plate as prepared in example 5.
Figure 22A:
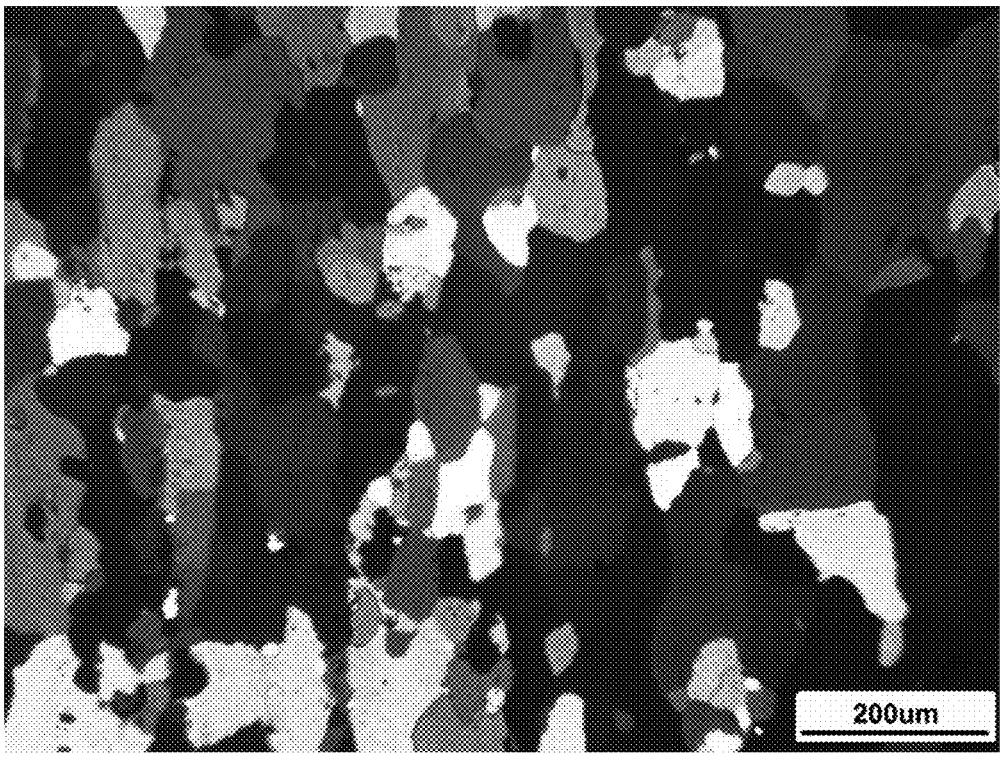
FIG. 22A shows the optical microstructure of the aged alloy plate as prepared in example 5.
Figure 22B:
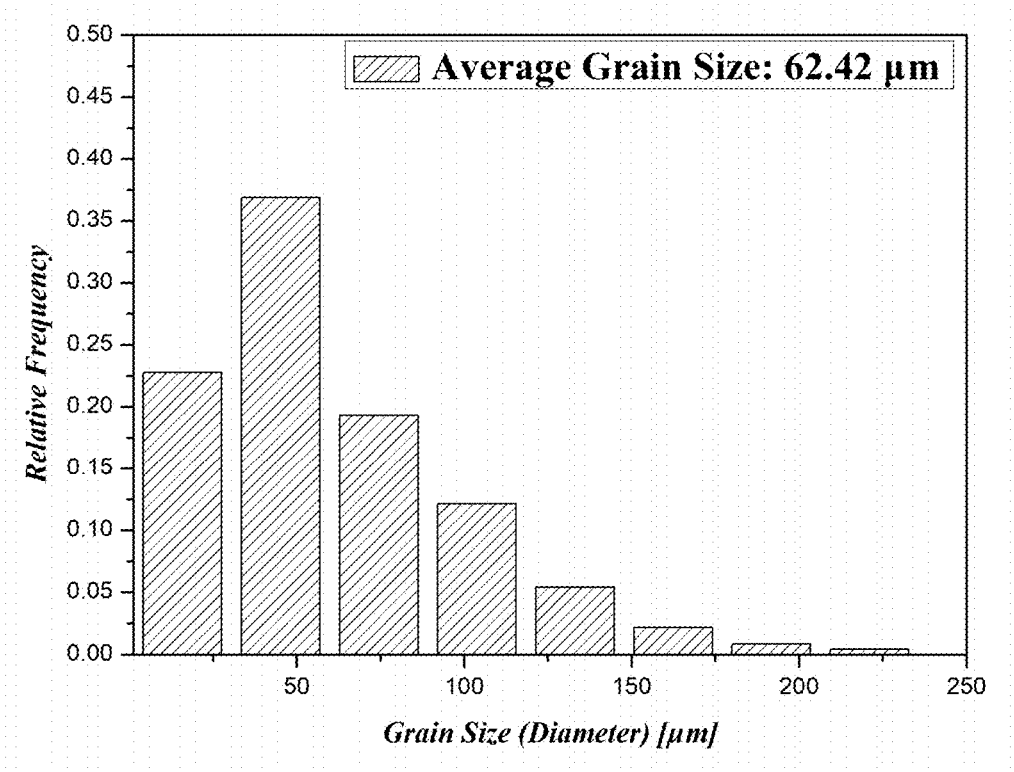
FIG. 22B shows the grain size distribution of the aged alloy plate as prepared in example 5.
Figure 23:
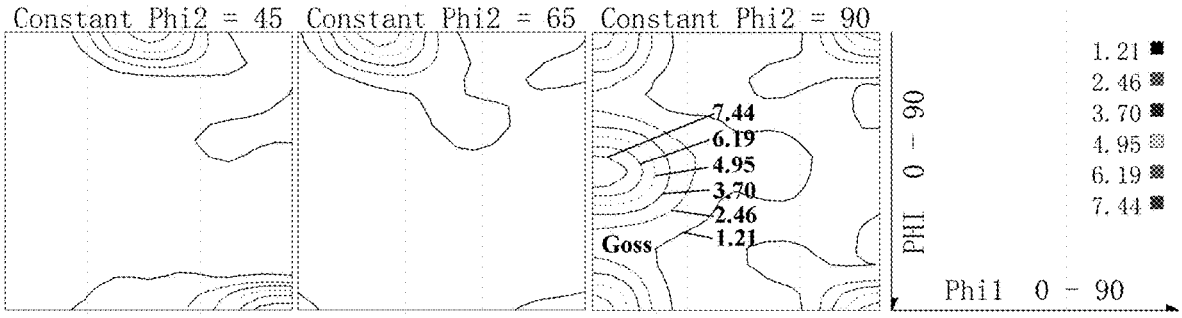
FIG. 23 shows the ODF sections of the aged alloy plate as prepared in example 6.
Figure 24A:
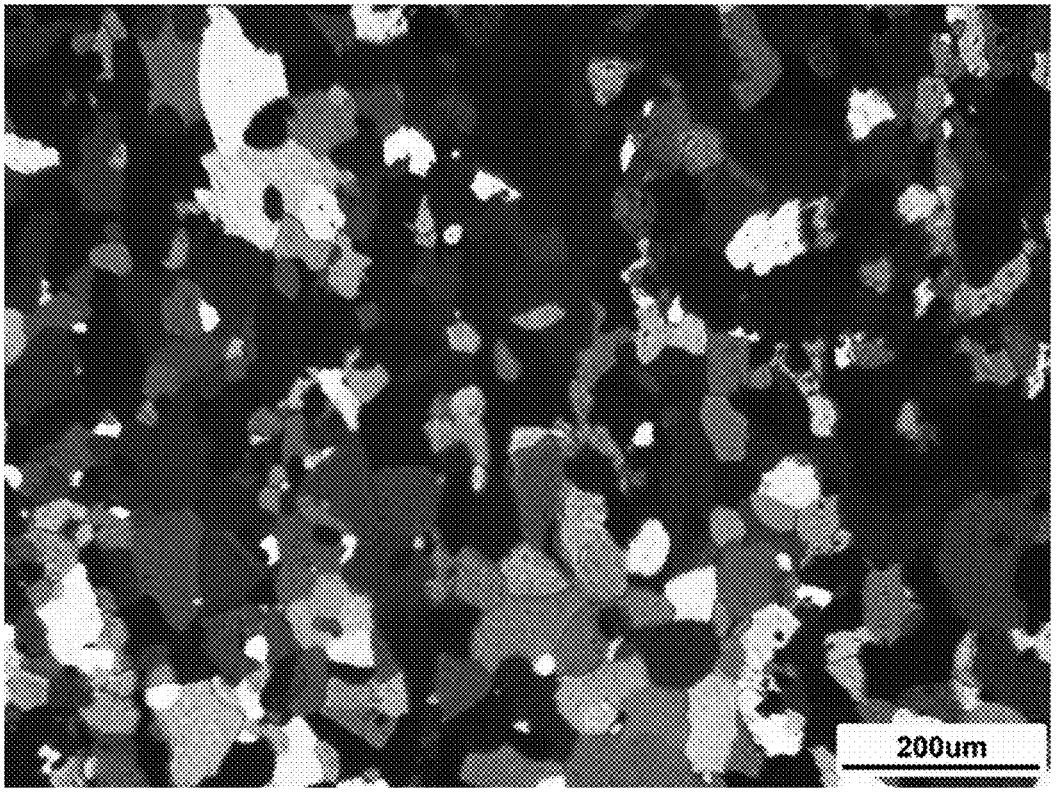
FIG. 24A shows the optical microstructure of the aged alloy plate as prepared in example 6.
Figure 24B:
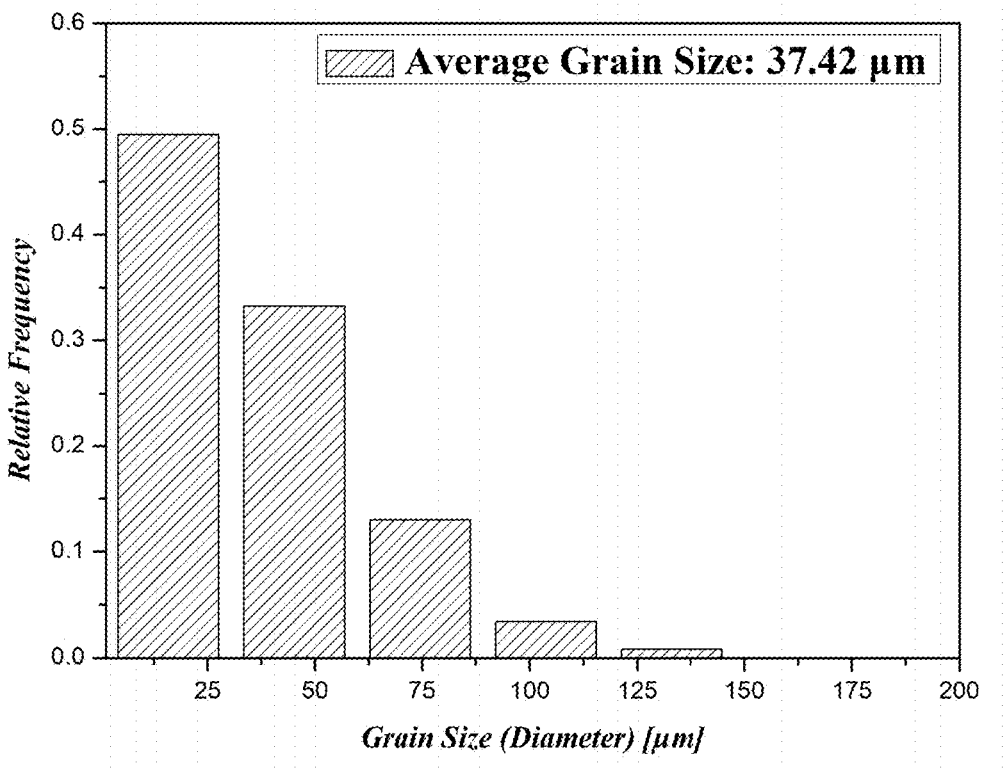
FIG. 24B shows the grain size distribution of the aged alloy plate as prepared in example 6.
Figure 25:
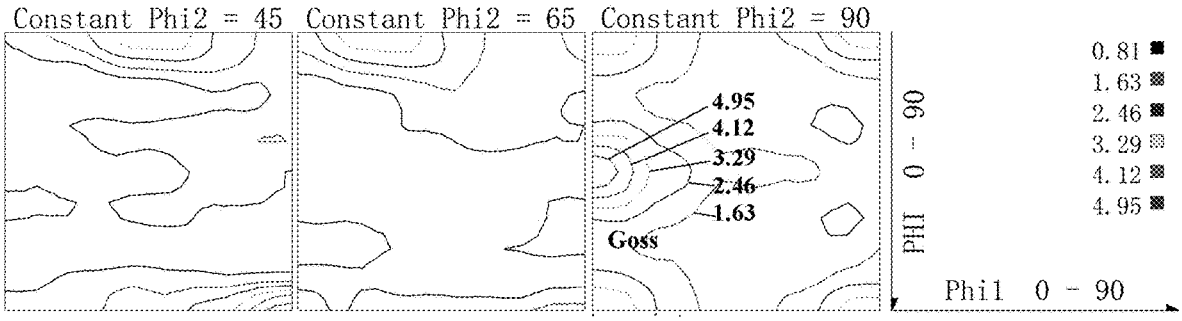
FIG. 25 shows the ODF sections of the aged alloy plate as prepared in example 7.
Figure 26A:
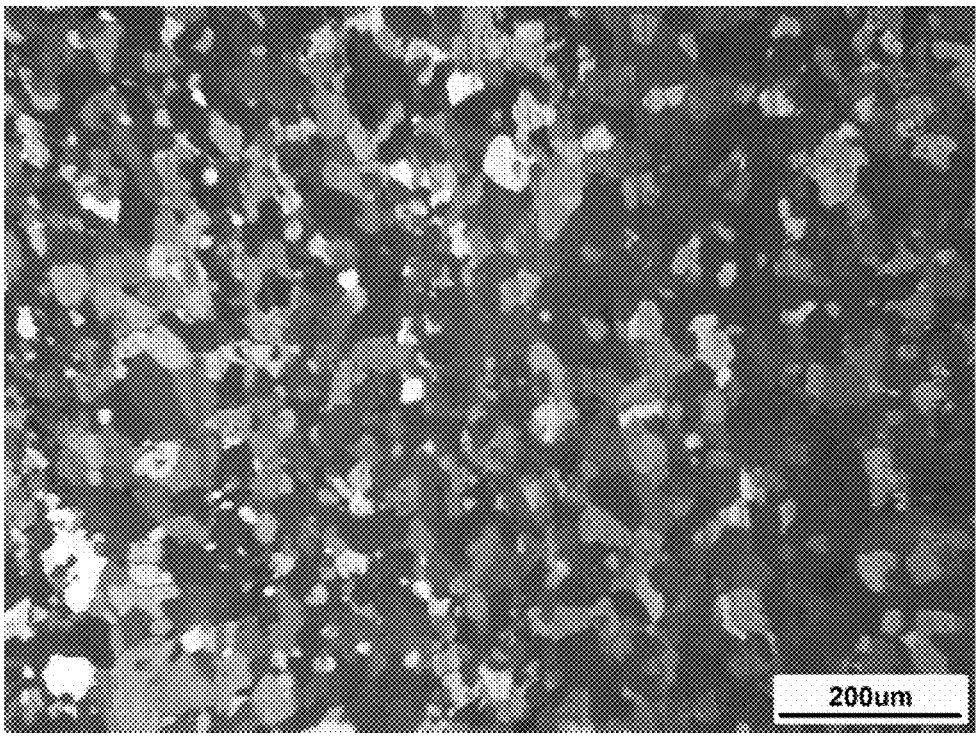
FIG. 26A shows the optical microstructure of the aged alloy plate as prepared in example 7.
Figure 26B:
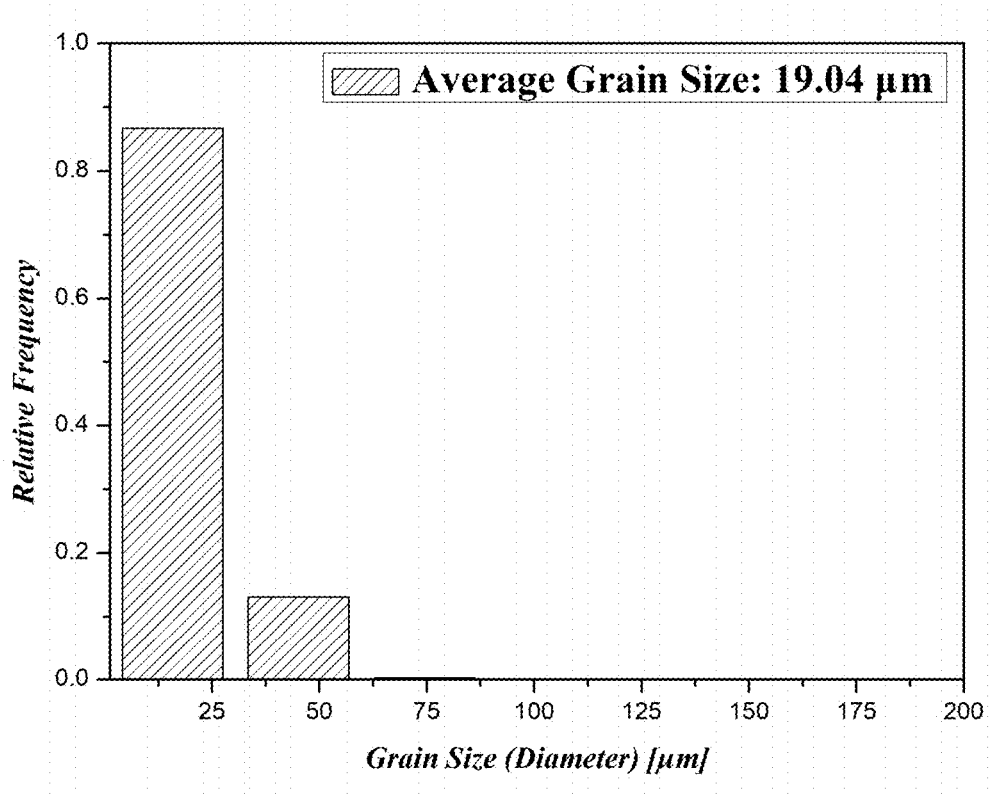
FIG. 26B shows the grain size distribution of the aged alloy plate as prepared in example 7.
Figure 27:
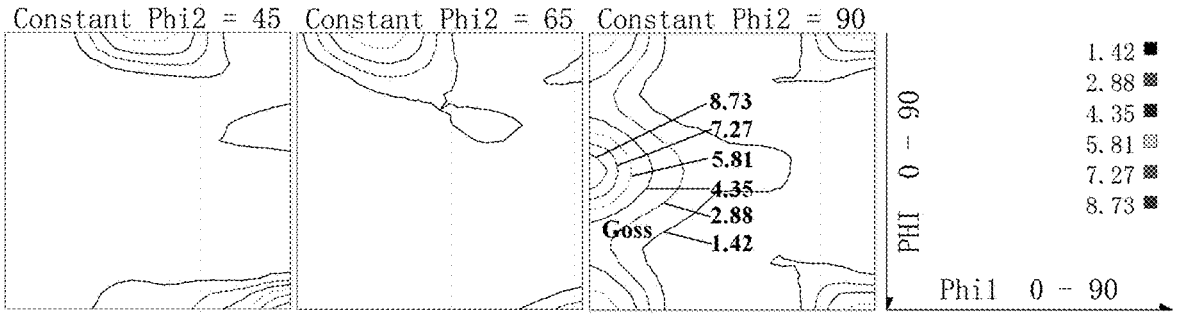
FIG. 27 shows the ODF sections of the annealed alloy plate as prepared in example 8.
Figure 28:
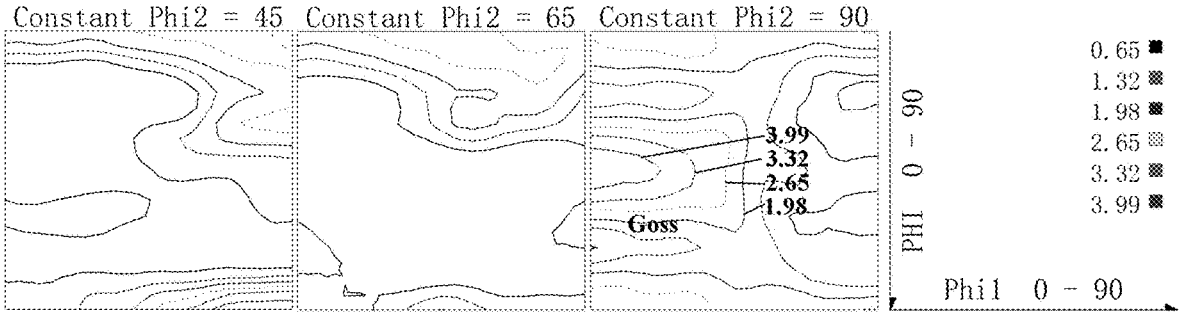
FIG. 28 shows the ODF sections of the annealed alloy plate as prepared in comparative example 1.
Figure 29:
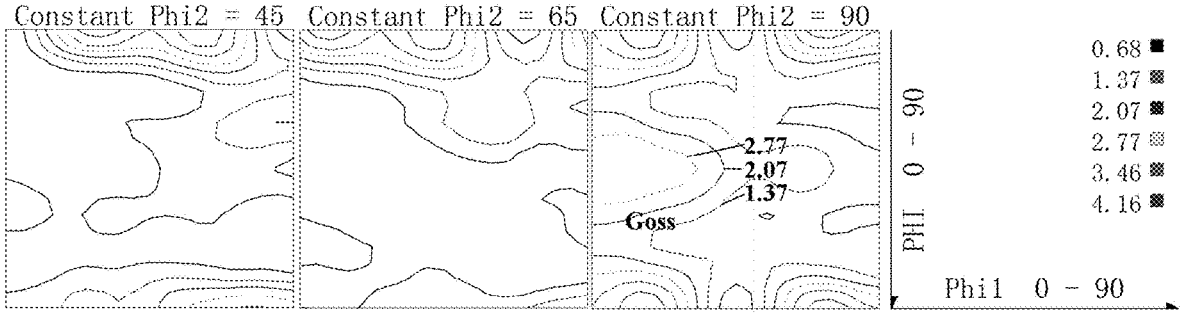
FIG. 29 shows the ODF sections of the annealed alloy plate as prepared in comparative example 2.
Figure 30:
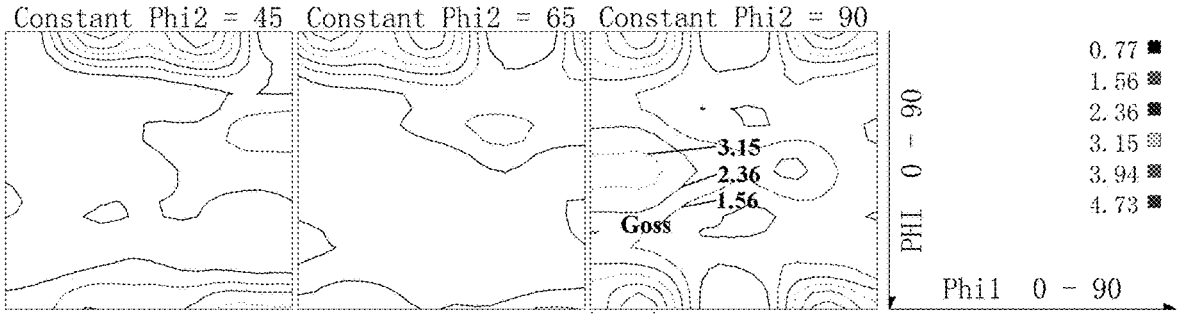
FIG. 30 shows the ODF sections of the annealed alloy plate as prepared in comparative example 3.

With reference to FIGS. 1-30, it can be seen that:

In example 1, the aged alloy plate prepared by a method comprising a homogenizing (at 480° C. for 48 hours), a hot rolling (at 470° C. with a deformation of 83%), a cold rolling (with a deformation of 5%), a recrystallization and annealing treatment (at 360° C. for 240 minutes), a solid solution treatment (at 460° C. for 90 minutes), and a natural aging treatment (for at least 96 hours) has an average grain size of 45.14 μm and a Goss texture intensity of 7.03.

In example 2, the aged alloy plate prepared by a method comprising a homogenizing (at 485° C. for 24 hours), a hot rolling (at 480° C. with a deformation of 88%), a cold rolling (with a deformation of 13%), a recrystallization and annealing treatment (at 390° C. for 120 minutes), a solid solution treatment (at 465° C. for 30 minutes), and a natural aging treatment (for at least 96 hours) has an average grain size of 39.81 μm and a Goss texture intensity of 8.35.

In example 3, the aged alloy plate prepared by a method comprising a homogenizing (at 495° C. for 72 hours), a hot rolling (at 485° C. with a deformation of 90%), a cold rolling (with a deformation of 20%), a recrystallization and annealing treatment (at 450° C. for 60 minutes), a solid solution treatment (at 480° C. for 90 minutes), and a natural aging treatment (for at least 96 hours) has an average grain size of 35.16 μm and a Goss texture intensity of 10.17.

In example 4, the aged alloy plate prepared by a method comprising a homogenizing (at 500° C. for 96 hours), a hot rolling (at 490° C. with a deformation of 95%), a cold rolling (with a deformation of 26%), a recrystallization and annealing treatment (at 360° C. for 60 minutes), a solid solution treatment (at 490° C. for 20 minutes), and a natural aging treatment (for at least 96 hours) has an average grain size of 23.44 μm and a Goss texture intensity of 10.20.

In example 5, the aged alloy plate prepared by a method comprising a homogenizing (at 505° C. for 72 hours), a hot rolling (at 495° C. with a deformation of 98%), a cold rolling (with a deformation of 32%), a recrystallization and annealing treatment (at 300° C. for 300 minutes), a solid solution treatment (at 505° C. for 30 minutes), and a natural aging treatment (for at least 96 hours) has an average grain size of 62.42 μm and a Goss texture intensity of 11.10.

In example 6, the aged alloy plate prepared by a method consisting of a homogenizing (at 475° C. for 24 hours), a hot rolling (at 470° C. with a deformation of 86%), a cold rolling (with a deformation of 35%), a recrystallization and annealing treatment (at 340° C. for 240 minutes), a solid solution treatment (at 465° C. for 5 minutes), and a natural aging treatment (for at least 96 hours) has an average grain size of 37.42 μm and a Goss texture intensity of 7.44.

In example 7, the aged alloy plate prepared by a method consisting of a homogenizing (at 505° C. for 24 hours), a hot rolling (at 465° C. with a deformation of 83%), a cold rolling (with a deformation of 39%), a recrystallization and annealing treatment (at 420° C. for 120 minutes), a solid solution treatment (at 505° C. for 20 minutes), and a natural aging treatment (for at least 96 hours) has an average grain size of 19.04 μm and a Goss texture intensity of 4.95.

In example 8, the aged alloy plate prepared by a method consisting of a homogenizing (at 470° C. for 96 hours), a hot rolling (at 465° C. with a deformation of 98%), a cold rolling (with a deformation of 16%), a recrystallization and annealing treatment (at 450° C. for 180 minutes), and a natural aging treatment (for at least 96 hours) has a Goss texture intensity of 8.73.

In comparative example 1, the aged alloy plate prepared by a method consisting of a homogenizing (at 480° C. for 36 hours), a hot rolling (at 475° C. with a deformation of 80%), a cold rolling (with a deformation of 50%), a recrystallization and annealing treatment (at 300° C. for 240 minutes), and a natural aging treatment (for at least 96 hours) has a Goss texture intensity of 3.99.

In comparative example 2, the aged alloy plate prepared by a method consisting of a homogenizing (at 470° C. for 24 hours), a hot rolling (at 465° C. with a deformation of 78%), a cold rolling (with a deformation of 55%), a recrystallization and annealing treatment (at 420° C. for 180 minutes), and a natural aging treatment (for at least 96 hours) has a Goss texture intensity of 2.77.

In comparative example 3, the aged alloy plate prepared by a method consisting of a homogenizing (at 470° C. for 96 hours), a hot rolling (at 465° C. with a deformation of 80%), a cold rolling (with a deformation of 52%), a recrystallization and annealing treatment (at 360° C. for 60 minutes), and a natural aging treatment (for at least 96 hours) has a Goss texture intensity of 3.15.

With reference to FIGS. 1-12, it can be seen that after the hot rolling at high temperature with a large deformation and a high final rolling temperature, a strong Brass texture was formed in the aluminum alloy plate. A cold rolling with a controlled deformation (5-50%) that was then carried out directly after the hot rolling makes it possible to obtain a cold-rolled plate that does not significantly reduce the Brass texture of the hot-rolled plate. Under the condition that the deformation of the cold rolling exceeds the controlled deformation (>50%), the Brass texture of the hot-rolled plate presents a random evolution trend, which is not conducive to the subsequent recrystallization and annealing treatment and solid solution treatment to obtain a cold-rolled Goss aluminum alloy plate with high Goss texture intensity.

It can be seen from the ODF diagrams in FIGS. 1-30 that under the condition that the hot-rolled plate is directly subjected to a cold rolling within a controlled deformation (5-50%), and then the obtained cold-rolled plate is subjected to a recrystallization and annealing treatment and a solid solution, it is possible to obtain a cold-rolled refined Goss-grain aluminum alloy plate with high Goss texture intensity. However, under the condition that the hot-rolled plate is directly subjected to a cold rolling beyond the controlled deformation (>50%), the Goss texture with high intensity could not be obtained in the subsequent annealing treatment due to the randomization of the Brass texture of the cold rolled plate.

With reference to the diagrams of the metallographic structure in FIGS. 1-30, it can be seen that the cold rolling with a large deformation would help to refine the Goss grain size of the alloy. Under the condition that the cold rolling is performed with a large deformation, the grain-refined Goss aluminum alloy plate could be prepared by the recrystallization and annealing treatment at a lower temperature. Under the condition that the cold rolling is performed with a small deformation, the refined Goss-grain aluminum alloy plate could also be prepared by appropriately increasing the temperature of the recrystallization and annealing treatment. A grain-refined Goss plate with a small grain size and a high Goss texture intensity could be prepared by a cold rolling with moderate deformation, a recrystallization and annealing treatment with a high temperature, a solid solution treatment, and a natural aging treatment.

In the present disclosure, the hot-rolled plate obtained by the hot rolling at high temperature with a large deformation and a high final rolling temperature is directly subjected to a cold rolling with a controlled deformation (5-50%) such that the Brass texture of the hot rolled plate is not significantly reduced. In this way, the increased deformation stored energy in the plate makes it possible to not only obtain a Goss texture with high intensity, but also significantly refine the grains in the subsequent recrystallization and annealing treatment and solid solution treatment. Thus, a refined Goss-grain aluminum alloy plate with high intensity is finally obtained.

In the present disclosure, the Goss grains could be significantly refined while obtaining a Goss texture with high intensity, and the fatigue resistance of the Goss textured aluminum alloy plate could be further improved.

In the present disclosure, the method is simple, and a cold-rolled aluminum alloy plate with a Goss grain size of less than 20 μm could be obtained, and is suitable for large-scale industrial production and application.

The above is not intended to limit the present disclosure in any form. Although the present disclosure has been described through the above-mentioned examples, these examples are not intended to limit the present disclosure. Any changes or modifications based on the technical concepts disclosed herein made by those skilled in the art, without departing from the scope of the present disclosure, should be considered to be equivalent embodiments of equivalent changes. Any simple modifications, and equivalent changes made to the above embodiments according to the technical concept of the present disclosure without departing from the content of the present disclosure shall fall within the scope of the present disclosure.

What is claimed is:

1. A refined Goss-grain aluminum alloy plate, consisting of the following compositions: 3.7-4.8 wt % of Cu, 1.2-1.7 wt % of Mg, 0.3-0.8 wt % of Mn, 0.03-0.10 wt % of Ti, and a balance of Al, wherein the refined Goss-grain aluminum alloy plate has a Goss texture intensity of not less than 3.9; and the refined Goss-grain aluminum alloy plate is prepared by a method comprising:

subjecting an Al—Cu—Mg alloy ingot to a homogenizing, a hot rolling at high temperature with a large deformation and a high final temperature, then directly to a cold rolling with a small or medium deformation, and then to a recrystallization and annealing treatment, a solid solution treatment, a water quenching, and a natural aging treatment, wherein, the homogenizing is performed at a temperature of 470-505° C. for 24-96 hours;

the hot rolling at high temperature with a large deformation and a high final temperature is performed at a temperature of 465-495° C., with a rolling deformation of 80%-98% and a final temperature of not less than 380° C.;

the cold rolling with a small or medium deformation is performed directly after the hot rolling under a rolling deformation of a single-pass and a multi-pass cold rolling of 5% to 50%;

the recrystallization and annealing treatment is performed at a temperature of 300-450° C. for 60-300 minutes;

the solid solution treatment is performed at a temperature of 460-505° C. for 5-90 minutes, and quenched with water;

the natural aging treatment is performed at ambient temperature for at least 96 hours; and the refined Goss-grain aluminum alloy plate has a Goss grain size of less than 100 μm.

2. The refined Goss-grain aluminum alloy plate of claim 1, wherein the refined Goss-grain aluminum alloy plate has a Goss grain size of not more than 20 μm.

* * * * *